US006235705B1

(12) United States Patent
Zembrodt et al.

(10) Patent No.: US 6,235,705 B1
(45) Date of Patent: May 22, 2001

(54) DRYER PEARLS

(75) Inventors: Anthony M. Zembrodt, Covington, KY (US); John A. Ferguson, Reynoldsburg, OH (US); Gunter Holzner, Geneva (CH)

(73) Assignee: Bath & Body Works, Inc., Reynoldsburg, OH (US)

( * ) Notice: Subject to any disclaimer, the term of this patent is extended or adjusted under 35 U.S.C. 154(b) by 0 days.

(21) Appl. No.: 09/504,281

(22) Filed: Feb. 15, 2000

(51) Int. Cl.[7] ..... C11D 3/60
(52) U.S. Cl. ..... 510/519
(58) Field of Search ..... 510/516, 519

(56) References Cited

U.S. PATENT DOCUMENTS 4,356,099 * 10/1982 Davies et al. ..... 252/90
4,410,441 * 10/1983 Davies et al. ..... 206/0.5
4,555,354 * 11/1985 Clarke et al. ..... 252/90
4,795,032 * 1/1989 Kandathil ..... 206/634

* cited by examiner

*Primary Examiner*—John Hardee
(74) *Attorney, Agent, or Firm*—Colucci & Umans; Peter C. Michalos; Angelo Notaro

(57) ABSTRACT

A product for providing anti-static and scent to clothes being laundered in a dryer has a plurality of beads, or pearls, of a polymer composition impregnated with anti-static agents and perfume contained in a mesh bag. The bag and pearls are placed in a clothes dryer with clothing being dried. The anti-static agents and perfume are transmitted to the clothing during the drying cycle. The pearls are composed of a mixture of polypropylene and polyethylene. A whitening agent, such as titanium dioxide, a blowing agent and coloring can all be added to the pearls.

11 Claims, 2 Drawing Sheets

DRYER PEARLS

FIELD AND BACKGROUND OF THE INVENTION

The present invention relates generally to the field of laundering clothing and in particular to a new and useful product for diffusing anti-static and pleasant scents to clothes after washing while being dried in a dryer.

Many different types of delivery systems are known for providing a variety of conditioning compositions to clothes.

U.S. Pat. No. 4,532,719, for example, discloses one embodiment of a clothes dryer fabric conditioning agent applicator having inner and outer containers. The inner container holds the conditioning agents in powder form and is porous to allow the powder through it. The outer container is also porous, and is disclosed as possibly being a sachet or bag. The outer container preferably has larger openings for the conditioning powder to flow more freely therethrough.

The applicator is placed loose in a dryer. The outer container prevents all of the powder from being released immediately or only into a small area. When operating, the motion of the dryer moves the applicator also, and causes the powder to move through both inner and outer containers.

The outer container is intended to be reusable and refillable with additional inner containers of conditioning powder, and it can be an open-weave material, although a form-retaining material, such as thermoplastic, is preferred.

U.S. Pat. No. 5,476,599 discloses that fabric conditioning agents may be compounded with other materials in solid forms such as pellets or tablets, or attached to a substrate. The pellets or tablets are not placed within a container, such as a sachet or mesh bag.

U.S. Pat. No. 5,482,632 teaches perfumed fabric conditioning compositions and indicates that the use of porous sachets containing fabric conditioning compositions are known for use in distributing the compositions within a clothes dryer.

A paper or cloth bag of fabric conditioner plugged with a solidified amount of conditioner which releases when heated to release the remaining conditioner in a clothes dryer is disclosed as a suitable applicator by U.S. Pat. No. 5,145,595. A specific anti-static fabric softening composition for use in a clothes dryer is included.

Several dispensing means for fabric conditioners are taught in U.S. Pat. No. 4,237,155. A sponge filled with conditioning powder, a sachet sealed with the composition, an aerosol spray can and porous substrates are all disclosed as being for distributing fabric conditioners in a clothes dryer. Specific compositions of fabric conditioners are also disclosed.

A diffuser which uses spherical solids to carry a deodorant composition is taught by U.S. Pat. No. 4,346,840. A volatile deodorant composition is adsorbed by the solids, which are spherical in at least one embodiment. The solids are contained within a porous container, or which has at least one opening. The container may be sealed until use, at which time it is unsealed and the volatile product is allowed to escape from the container and solid carriers. Depending on the size of the solid carriers, the rate of evaporation of the volatile substance will vary.

SUMMARY OF THE INVENTION

It is an object of the present invention to provide a reusable laundry device for adding perfume to clothing and dissipating static electricity charge from clothing in a clothes dryer.

Accordingly, a plurality of pearls of a solid polymer composition carrying anti-static agents and perfume for treating clothing contained in a mesh bag are provided. The pearls are between 0.1" and 1" in diameter and may contain a whitening agent to provide a pearlescent appearance, additional coloring and a blowing agent. The mesh bag is selected so that the width of the mesh openings are smaller than the diameter of the smallest size pearls.

The polymer composition contains from 0–90% by weight polypropylene and 0–90% by weight of polyethylene. It is impregnated with 0.5–10% by weight of an anti-static agent, 0–25% by weight of perfume, and optionally, 0–10% by weight of whitening agent, 0–1% by weight coloring and 0–10% of a blowing agent.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENTS

Figure 1:
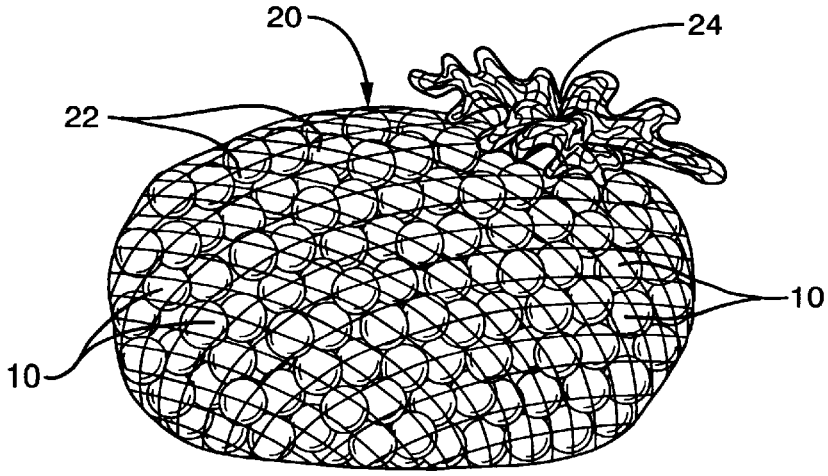
FIG. 1 is a schematic perspective view of a laundry device in accordance with the present invention.

The dryer pearls of the invention are used to transmit perfume and provide anti-static compositions for scenting clothing and removing static electricity charges in a clothes dryer. Referring now to the drawings, in which like reference numerals are used to refer to the same or similar elements, FIG. 1 shows a plurality of polymer dryer pearls 10 impregnated with the desired laundering compositions are placed into a mesh bag 20 having openings 22 smaller than the diameter of the smallest dryer pearl and the bag 20 and pearls 10 are inserted into a dryer for use.

Figure 3:
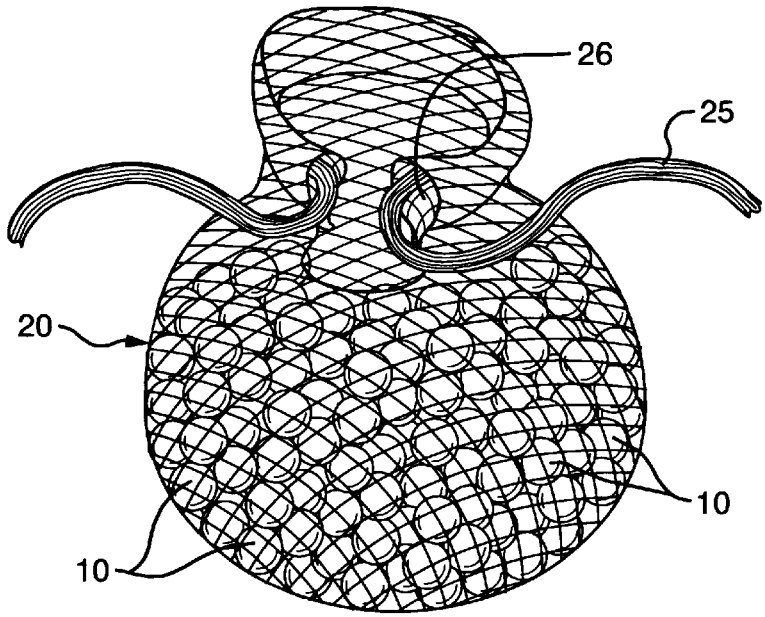
FIG. 3 is a view similar to FIG. 1 of a third embodiment of the invention.

Bag 20 may be made of cloth, polyester or other plastic open mesh fabric closed around the pearls and held closed by a plastic band or string 24. In one alternative, shown in FIG. 3, the string may be a drawstring 25 sewn into a channel 26 at the opening of the bag 20. The drawstring 25 is pulled tight and knotted to secure the pearls 10 inside the bag 20. The drawstring 25 is especially preferred for use when the bag 20 is made of cloth.

The pearls 10 are preferably sized between 0.1 inch and 1 inch in diameter. Pearls having a diameter of about 0.25 inch are preferred. The pearls 10 are formed from a molded polymer composition and impregnated with any desired laundry compositions, including an anti-static agent and perfume Anti-static agents remove and control static building up on clothing during drying by dissipating static charge. Perfume is used to provide a pleasant scent to the clothes. The perfume will also act as an air freshener when the bag 20 is stored outside the clothes dryer.

Coloring and a whitening agent may be added to improve the appearance of the pearls. The whitening agent is used to provide a pearlescent appearance to the pearls 10. Typically, when perfume is added to a polymer which is otherwise clear or white, it will turn a yellowish color. The whitening agent can be used to counteract this effect. A blowing agent can be added to give a larger surface area to the pearls and control the size of the pearls, as well as assist with cooling of the prepared pearls.

The following table shows the acceptable percent weight ranges for each of these components and identifies a preferred composition for the pearls:

| Component | Range (% wt.) | Preferred Composition (% wt.) |
|---|---|---|
| Polypropylene | 0–90% | 46.5% |
| Polyethylene | 0–90% | 30.5% |
| Anti-static agent | 0.5–10% | 5% |
| Perfume | 0–25% | 15% |
| Whitening agent | 0–10% | 2% |
| Coloring | 0–1% | 0.1% |
| Blowing agent | 0–10% | 1% |

The pearls are formed using a molding process. The polymer mixture is selected to obtain the best balance of retention and release rate. Polypropylene is used as a less crystalline polymer than high density polyethylene to help dissolve the perfume. Polypropylene does not release perfume as readily as polyethylene and the amount used is selected based largely on this property. Polypropylene will release the perfume when heat is added, which makes it ideal for use in a dryer. Polypropylene is stable at the temperatures encountered in a clothes dryer.

Polyethylene in the form of high density polyethylene (HDPE) or low density polyethylene (LDPE) are used to permit fragrance to be released at room temperature as well, or in the case of a dryer cycle using low or no heat. Polyethylene is stable for use in a clothes dryer as well. LDPE is preferred because it releases perfume more readily than HDPE. Mixing polyethylene (HDPE or LDPE) with the polypropylene allows a balance between release rate and useful life of the perfume in the pearls.

While a polymer mixture of polypropylene and polyethylene is preferred for use, a polymer known as PEBAX which is a polyester-block amide-thermoplastic elastomer is also suitable for use in making the pearls. PEBAX is especially useful where very high concentrations of perfume are desired for use, since up to 40% by weight perfume can be held by this polymer. PEBAX Grade 2533 was used to achieve the 40% by weight perfume composition. Other polymers having similar properties in the presence of the heat generated in a clothes dryer and which can dissolve and permit the sustained release of perfume may also be used.

Suitable anti-static agents include those based on cocoa amine and tallow amine having the chemical structure:

$$RN(CH_2CH_2OH)_2$$

where R may be any suitable and known hydrocarbon radical.

Commercially available agents of a related type to the tallow and cocoa amines include those sold under the trademarks ARMOSTAT 300 and ARMOSTAT 400 by Akzo. These compounds are tertiary ethoxylated amines. Other anti-static agents that are acceptable for use include any of the Larostats sold by PPG. These agents have varied formulas, with most including a diethanolamine end group. Larostats are usually either proprietary blends or laurylalkanolamides.

As noted above, the range of anti-static agent used is between 0–10% by weight, with between 3% and 8% by weight preferred, and 5% by weight most preferred.

The perfume selected for use can be any scent which is pleasing and desired for use with clothing, provided the perfume can withstand temperatures of between 250–450° F. When perfume is used in concentrations of at least 15% by weight, between 50–90 drying cycles have been obtained from the pearls.

Coloring and whitening agent are added to improve the appearance of the pearls. A whitening agent such as titanium dioxide ($TiO_2$) is used to impart a pearlescent appearance to the pearls. Coloring can be used to change the color from white to pink, blue, or any other color desired.

A blowing agent is not required to make the dryer pearls, but a blowing agent is useful for controlling the size of the pearls. Various blowing agents for foaming polyolefins are known. Blowing agents which decompose and release nitrogen gas, referred to as azodicarbonamide type agents, provide about 32% by weight of gaseous products. Other derivatives of these types, sold under the mark CELOGEN by Uniroyal, include CELOGEN AZBN. Pentane gas, carbon dioxide and water reacted with isocyanates can also be used as the blowing agent. Endothermic blowing agents which lose water under certain conditions are particularly useful as this type can also help cool the dryer pearls to help trap volatile perfume in the polymer composition.

Once a plurality of the pearls 10 have been formed, they are inserted into the mesh bag 20, which can be made of any material which will not melt or fall apart during a drying cycle. The bag is intended to retain the beads the entire time. As noted above, materials such as cloth, nylon, polypropylene, polyethylene or other similar polymers are preferred for use. A mesh bag made of HDPE is preferred, with a cloth bag having a drawstring being most preferred.

The bag should be sized to at least permit tying of the ends or securing using a drawstring. One method of securing the bag includes providing sufficient material to permit tying the bag closed, folding the excess back over the bag and sealing the end closed, such as by heat sealing when HDPE is used as the mesh bag material. The mesh size is between 1/16 inch to about 0.5 inch across in a preferred embodiment, and most preferably, about 1/8 inch across when a diamond mesh pattern is used.

Figure 2:
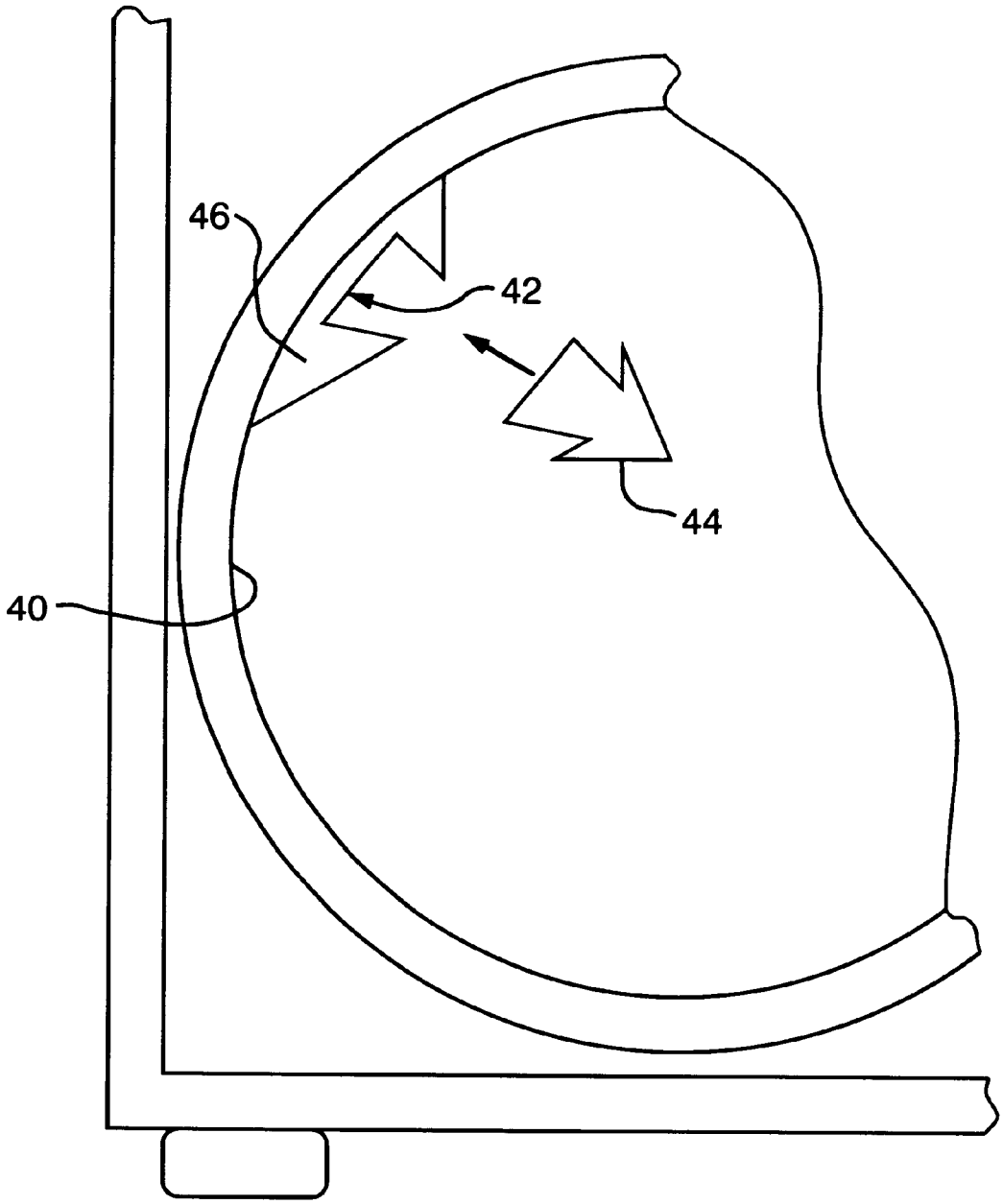
FIG. 2 is a front sectional view of a clothes dryer having a second embodiment of the invention fixed therein.

In a second embodiment of the delivery system for the composition used to form the pearls shown in FIG. 2, a clothes dryer has a drum inner wall 40 to which a mounting fixture 46 is attached. The mounting fixture 46 may be secured using double-sided tape or other heat resistant adhesives or other known connecting means, including threaded connectors. Mounting fixture 46 has a keyway groove 42 which corresponds and is complimentary to the shape of a polymeric insert 44 made from the same composition as the dryer pearls 10.

The polymeric insert 44 is held in the keyway groove 42 for use during a clothes drying cycle to provide anti-static and other laundering compositions. The polymeric insert 44 may have any shape, provided there is a complimentary key for attaching to the mounting fixture 46 via the keyway groove 42. The polymeric insert is advantageous since it does not have to be found and removed from finished laundry after each drying cycle, and it will continue to provide a pleasant scent to the dryer, even when the dryer is not being used.

While a specific embodiment of the invention has been shown and described in detail to illustrate the application of the principles of the invention, it will be understood that the invention may be embodied otherwise without departing from such principles.

What is claimed is:

1. A laundry device for use in a clothes dryer, the device comprising:

a mesh bag which retains its form at temperatures at least up to those encountered in a clothes dryer; and a plurality of pearls, each pearl formed from up to 90% by weight of a polymer, 0.5–10% by weight of an anti-static agent, 0.1–40% by weight of perfume and 0.1–10% by weight of a whitening agent.

2. A laundry device according to claim 1, wherein the mesh bag is made of one of cloth, nylon, polypropylene and polyethylene.

3. A laundry device according to claim 2, wherein the polymer is selected from the group consisting of polypropylene, polyethylene and mixtures thereof.

4. A laundry device according to claim 3, wherein the anti-static agent is present in an amount from 3%–8% by weight.

5. A laundry device according to claim 4, wherein the whitening agent is titanium dioxide.

6. A laundry device according to claim 2, wherein each of the plurality of pearls are sized between 0.1 inch and 1 inch in diameter, each of the pearls being larger than a mesh size of the mesh bag.

7. A laundry device according to claim 6, wherein the diameter of the pearls is at least 0.25 inch and the mesh size is about 0.125 inch.

8. A laundry device according to claim 1, wherein each of the pearls comprises 75–90% by weight of polymer, 3%–8% by weight of anti-static agent, about 1% by weight of whitening agent, and from 8–21% by weight of perfume.

9. A laundry device according to claim 8, wherein each of the pearls further comprises 0–10% of a blowing agent and 0–1% of a coloring.

10. A laundry device according to claim 8, wherein the polymer is selected from the group consisting of polypropylene, polyethylene and mixtures thereof.

11. A laundry device according to claim 8, wherein the polymer comprises about 46.5% by weight of polypropylene and about 30.5% by weight of polyethylene.

* * * * *